US010247046B2

(12) United States Patent
Schuster et al.

(10) Patent No.: US 10,247,046 B2
(45) Date of Patent: Apr. 2, 2019

(54) DEVICE AND METHOD FOR RELIABLY STARTING ORC SYSTEMS

(71) Applicant: ORCAN ENERGY AG, München (DE)

(72) Inventors: Andreas Schuster, Tussenhausen (DE); Asim Celik, München (DE); Andreas Grill, München (DE); Jens-Patrick Springer, München (DE); Daniela Gewald, Rosenheim (DE); Richard Aumann, München (DE)

(73) Assignee: ORCAN ENERGY AG, München (DE)

( * ) Notice: Subject to any disclaimer, the term of this patent is extended or adjusted under 35 U.S.C. 154(b) by 119 days.

(21) Appl. No.: 15/030,862

(22) PCT Filed: Oct. 20, 2014

(86) PCT No.: PCT/EP2014/072393
§ 371 (c)(1),
(2) Date: Apr. 20, 2016

(87) PCT Pub. No.: WO2015/059069
PCT Pub. Date: Apr. 30, 2015

(65) Prior Publication Data

US 2016/0251983 A1 Sep. 1, 2016

(30) Foreign Application Priority Data

Oct. 23, 2013 (EP) ..... 13189918

(51) Int. Cl.
*F01K 13/02* (2006.01)
*F01K 13/00* (2006.01)
(Continued)

(52) U.S. Cl.
CPC ..... *F01K 13/02* (2013.01); *F01K 11/00* (2013.01); *F01K 13/006* (2013.01); *F01K 25/08* (2013.01)

(58) Field of Classification Search
CPC ..... F01K 11/00; F01K 13/006; F01K 13/02; F01K 25/08
See application file for complete search history.

(56) References Cited

U.S. PATENT DOCUMENTS

2009/0188253 A1* 7/2009 Smith ..... F01C 1/16 60/657
2010/0154421 A1* 6/2010 Vaisman ..... F01K 25/10 60/670
(Continued)

FOREIGN PATENT DOCUMENTS

CN 101765703 A 6/2010
CN 102536365 A 7/2012
(Continued)

OTHER PUBLICATIONS

International Search Report for PCT/EP2014/072393 dated Jan. 9, 2015.
(Continued)

*Primary Examiner* — Audrey K Bradley
(74) *Attorney, Agent, or Firm* — Moore & Van Allen PLLC; Henry B. Ward, III

(57) ABSTRACT

The invention relates to a thermodynamic cycle apparatus, comprising: a working medium; an evaporator for evaporating the working medium; an expansion machine; a condenser, and a pump, wherein the geometrical arrangement of the evaporator is selected such that the condensed working medium can flow from the condenser to the evaporator by force of gravity and the working medium can circulate in a closed circuit via the evaporator and the condenser wherein a predetermined head height of the liquid working medium
(Continued)

can be provided at the pump. The invention additionally relates to a method of starting the thermodynamic cycle apparatus the method comprising the following steps: applying heat to the evaporator and evaporating the working medium in the evaporator, wherein the working medium is caused to flow to the condenser; condensing the working medium in the condenser; starting the pump when a predetermined head height of the working medium at the pump is reached or exceeded.

16 Claims, 3 Drawing Sheets

(51) Int. Cl.
*F01K 11/00* (2006.01)
*F01K 25/08* (2006.01)

(56) References Cited

U.S. PATENT DOCUMENTS

2012/0042650 A1* 2/2012 Ernst ..... F01K 23/065 60/615
2012/0227404 A1* 9/2012 Schuster ..... F01K 15/02 60/651
2012/0312009 A1 12/2012 Smith et al.
2015/0013338 A1* 1/2015 Smague ..... F01K 13/02 60/645

FOREIGN PATENT DOCUMENTS

| | | | |
|---|---|---|---|
| CN | 103180554 | A | 6/2013 |
| FR | 2985767 | A1 | 7/2013 |
| WO | 2006131759 | A2 | 12/2006 |
| WO | 2008031716 | A2 | 3/2008 |
| WO | 2010029905 | A1 | 3/2010 |
| WO | 2011057724 | A2 | 5/2011 |
| WO | 2012021881 | A2 | 2/2012 |

OTHER PUBLICATIONS

English language translation of Chinese Search Report for related Chinese Patent Application No. 2014800587362.
Office Action issued by the Russian Patent Office for corresponding Russian Patent Application No. 2016112366 dated Jan. 25, 2018 (English language translation attached).

* cited by examiner

DEVICE AND METHOD FOR RELIABLY STARTING ORC SYSTEMS

FIELD OF THE INVENTION

The invention relates to a thermodynamic cycle apparatus, in particular an organic Rankine cycle apparatus, comprising: a working medium; an evaporator for evaporating the working medium; an expansion machine for generating mechanical energy while expanding the evaporated working medium; a condenser for condensing and possibly subcooling the working medium, in particular the working medium expanded in the expansion machine; and a pump for pumping the condensed working medium to the condenser when the thermodynamic cycle apparatus is in operation. The invention additionally relates to a method of starting a thermodynamic cycle apparatus of the type in question.

PRIOR ART

An ORC system comprises the following main components: a feed pump conveying the liquid working medium to the evaporator with a substantial increase in pressure, an evaporator in which the working medium is evaporated, an expansion machine in which the highly pressurized vapor is expanded whereby mechanical energy is generated, said mechanical energy being convertible into electric energy through a generator, and a condenser in which the low pressure vapor coming from the expansion machine is liquefied. From the condenser the liquid working medium is returned to the feed pump of the system via a possible storage tank (feed tank) and a suction line.

During the startup process, a sufficient amount of working medium should preferably be present in the suction line of the pump or also in the feed tank, so that a sufficient amount of medium will be available to the pump during the entire startup operation.

A second condition for trouble-free conveyance of working medium through the pump is a sufficient head height of the fluid (working medium) applied to the pump. The head height (NPSH) is a parameter that is influenced not only by the geodetic head height but also by the thermodynamic state of the working medium, a circumstance that can be explained as follows hereinbelow. If subcooling (the distance to the boiling point) of the fluid is not sufficiently high at the entrance of the pump, a short-time evaporation of the fluid may occur at the pump entrance. This phenomenon may lead to pump damage and to a partial or complete failure of pump delivery.

This is referred to as cavitation. The distance to the boiling pressure of the fluid at the entrance of the pump is referred to as head height. A parameter for quantifying this head height is the NPSH value (Net Positive Suction Head). In this respect, a difference is made between the required, pump-specific ($NPSH_r$) head height and the applied ($NPSH_a$) head height, the applied $NPSH_a$ value depending on several plant- and operation-specific parameters (temperature, pressure originating from the geodetic head height, saturation pressure, inert gas partial pressure, the inert gas partial pressure being a further partial pressure of a non-condensing gas that may additionally be present in the circuit). For a reliable operation of the pump, the applied $NPSH_a$ value must always be higher than the required $NPSH_r$ value.

Especially for circulation systems, like an ORC, cavitation is a challenge. Here, liquid condensate with a small distance or even with no distance at all to the boiling point and, consequently, with a small applied $NPSH_a$ value must be pumped. Since the required $NPSH_r$ value is predefined by the structural design of the pump, it can only be influenced to a minor extent, and it must be guaranteed by process technological means at any moment in time of pump operation that the applied $NPSH_a$ value does not fall below the required value.

When an ORC system is shut down, e.g. due to failure/deactivation of the heat source or due to an emergency shutdown of the system, this may lead to an uncontrolled distribution of working medium in the system (e.g. in the expansion machine, horizontal tubes or fluid pouches); in this case, the working medium will not flow to the feed tank. This may have the effect that the amount of working medium available for the feed pump does not suffice for the whole startup process. The startup process comprises filling the evaporator, evaporating the working medium and, in so doing, building up pressure, starting the expansion machine as well as the beginning of condensation and, consequently, of the return flow of working medium to the feed pump.

The disadvantageous distribution of working medium and the resultant difficult or even impossible startup is a well known problem for which various solutions are suggested in the prior art. EP 2 613 025 A1 (System and methods for cold startup of Rankine cycle devices) suggests an ordered distribution of the working medium by abrupt opening of a valve and by thus "purging" parts of the system of accumulations of liquid working medium. To this end, it is, however, necessary to use one or a plurality of valves as additional components. In EP 2 345 797 A2 (Fluid feedback pump to improve cold start performance of organic Rankine cycle plants), the working medium is pumped to the right locations in the system by means of additional pumps. Also in this case, additional components in the form of pumps are required so as to guarantee a reliable start of the system.

The prior art also teaches that vapor lines should always slope towards the condenser/feed tank. This means that the evaporator must be accommodated at the highest point and that, in the standstill condition, condensate flows via the condenser towards the feed tank. In the case of the compact structural design of ORC systems this is, however, difficult to realize or cannot be realized at all, especially if a maximum overall height has to be observed. Even if the evaporator were accommodated at the highest point, which would cause the working medium to collect automatically in the condenser/feed tank, the problem of system conditions with an insufficient applied head height $NPSH_a$, as described hereinbefore, would not be solved.

However, the two above-mentioned prior art disclosures also fail to solve a further problem: when the ORC system is being started, a situation may arise in which the feed pump and possibly also the feed line thereof may have a temperature that is higher than that of the working medium sucked in from the condenser or the working medium just condensing in the condenser. The condenser, which serves as a heat sink in the circuit, may, in the standstill condition, become the coldest point in the system, e.g. when the external condenser is installed outside in the air at cold outside temperatures and when the temperature of a pump located in a machine housing/building lies at a temperature that is higher than the outside temperature. Due to the large heat transfer areas existing in the condenser or due to the dwell time of the medium in the condenser, the temperature of the pump itself may temporarily be higher than that of the condenser even if the ambient temperatures of the pump and of the condenser are identical. Hence, there is an increase in temperature from the condenser to the feed pump and this leads to a reduction of the applied head height at the pump entrance ($NPSH_a$). The effect is that the pump cavities and that no working medium is conveyed. This prevents starting of the system and may cause damage to the pump. Even after temperature compensation between the feed pump, the feed line and the condenser, the then applied head height $NPSH_a$ may, in particular in systems having a compact structural design without large differences in height and thus without much geodetic head height, be smaller than the required head height $NPSH_r$, and this, in turn, will lead to cavitation.

The problem of cavitation in ORC plants is known and, according to the disclosure of DE 10 2009 053 390 B3, it can be solved e.g. by additionally feeding inert gas into a feed tank/condenser.

Summarizing, the following can be specified as a motivation for the present invention: for reliably starting an ORC system, a sufficient amount of working medium must be present at the feed pump of the system with sufficient head height. In an ORC system, a maldistribution of liquid working medium may occur in the standstill condition or as a result of a poorly controlled shutdown of the system, whereby starting of the system is prevented because the amount of medium upstream of the feed pump is insufficient. In addition, a disadvantageous temperature distribution may occur in the working medium circuit, the working medium in the area upstream of the feed pump may e.g. have a higher temperature than at the coldest point in the system. Due to the small head height applied to the pump in this condition, cavitation of the pump may occur. This prevents a reliable start of the system. Under comparatively cold atmospheric conditions, a startup of the plant may also be prevented by a cold system condition. For example, there may be an increase in the viscosity of the working medium or of some other medium, such as a lubricant, existing in the circuit, whereby conveyance of the medium through the feed pump may be impaired.

DESCRIPTION OF THE INVENTION

It is the object of the present invention to overcome the above described drawbacks at least partially.

This object is achieved by a device according to claim 1.

The thermodynamic cycle apparatus, in particular the ORC device, according to the present invention comprises a working medium; an evaporator for evaporating and, optionally, additionally superheating the working medium; an expansion machine for generating mechanical energy while expanding the evaporated working medium; a condenser for condensing and, optionally, additionally subcooling the working medium, in particular the working medium expanded in the expansion machine; and a pump for pumping the condensed working medium to the condenser when the thermodynamic cycle apparatus in operation, wherein the geometrical arrangement of the evaporator is selected such that, prior to starting the pump, the condensed working medium can flow from the condenser to the evaporator by force of gravity and the working medium can circulate in a closed circuit via the evaporator and the condenser, whereby in particular at least a predetermined minimum head height of the liquid working medium can be provided at the pump.

The above is advantageous insofar as a head height which suffices for trouble-free starting of the pump is provided during the startup process of the thermodynamic cycle apparatus. The closed circuit (shut-off devices which might impede the circulation being not closed in the standstill condition) is designed such that the fluid contained in the circuit flows to the evaporator due to gravitational forces without being additionally driven. When the system is started from the standstill condition, the evaporator has heat applied thereto, so that it constitutes the hottest component in the system. The working medium contained therein is evaporated and, possibly, also superheated and the resultant vapor heats all the plant components located above the evaporator. If liquid medium should have collected in other components of the plant (e.g. in the expansion machine, horizontal tubes or fluid pouches), it will be evaporated through such heating and will subsequently condense at the coldest point of the plant. The coldest point in the system is normally the condenser. If this should not be the case in the standstill condition, the condenser can be adjusted as coldest point by controlling the heat sink (e.g. starting cooling at the condenser). From the condenser the working medium flows as an input to the feed pump. The geometrical arrangement is chosen (height difference) such that the condensate can flow to the evaporator by force of gravity (density difference between vapor and liquid). A natural circulation is created, which causes an independent positioning of the liquid working medium. This means that liquid working medium is collected in the low-lying part of the plant (e.g. upstream of the pump) and that, before the pump is started, a sufficient amount of working medium with sufficient head height is present upstream of the pump.

According to a further development of the device according to the present invention, the evaporator may be located on a lower level than the condenser in the geometrical arrangement. An evaporator and possibly also tubes lying on a level lower than that of the condenser make it possible that the fluid contained in the circuit flows to the evaporator through gravitational forces without being additionally driven.

Another further development is to be seen in that the closed circuit between the condenser and the evaporator also comprises the non-started pump and/or the closed circuit between the evaporator and the condenser also comprises the expansion machine. In this way, the working medium in the circuit can, in the case of structural designs of the pump allowing a flow of fluid in the standstill condition, also flow through the pump without the latter having been started.

According to another further development, the pump may be located on a lower level than the evaporator. The head height can thus be increased still further.

Another further development is to be seen in that thermodynamic cycle apparatus may further comprise a bypass valve for bypassing the expansion machine in the circuit.

According to another further development, the thermodynamic cycle apparatus may further comprise a feed tank for collecting the condensed working medium, the feed tank being arranged in the closed circuit between the condenser and the evaporator, in particular between the condenser and the pump.

Another further development is to be seen in that, in addition, there may be provided at least one sensor for measuring the head height of the working medium upstream of the pump, in particular a sensor for measuring the pressure of the working medium and/or a sensor for measuring the temperature of the working medium.

According to another further development, the thermodynamic cycle apparatus may additionally comprise a bypass valve for bypassing the pump in the circuit.

In accordance with another further development, the thermodynamic cycle apparatus may additionally comprise a recuperator for transferring thermal energy from the expanded working medium to the working medium pumped between the pump and the evaporator when the thermodynamic cycle apparatus is in operation, the recuperator being arranged between the expansion machine and the condenser; and a bypass valve for bridging the recuperator in the circuit, the bypass valve for bridging the recuperator may here especially also be the bypass valve for bypassing the pump.

When a recuperator is used and when e.g. the tubing between the pump and the evaporator is installed such that it passes through the recuperator so as to preheat, during operation (normal operation) of the thermodynamic cycle apparatus, the working medium pumped therein with heat from the expanded evaporated working medium downstream of the expansion machine and upstream of the condenser, a bypass valve for bridging the recuperator must be provided for starting the cycle apparatus in the way described in the present invention, since the recuperator, which is arranged on a higher level than the evaporator, will otherwise not allow natural circulation.

The above mentioned task is additionally solved by a method according to claim 10.

The method disclosed in the present invention and used for starting a thermodynamic cycle apparatus according to the present invention or one of the further developments thereof comprises the following steps: applying heat to the evaporator and evaporating the working medium in the evaporator, optionally, additionally superheating the working medium in the evaporator, whereby working medium is caused to flow to the condenser; condensing the working medium in the condenser; starting the pump when a predetermined head height of the working medium at the pump is reached or exceeded.

The method according to the present invention has the advantages that have already been described in connection with the device according to the present invention.

The method according to the present invention can be further developed in such a way that the pump is started when a measured head height has been reached or exceeded, or when a predetermined period of time has elapsed after the beginning of the application of heat to the evaporator.

According to another further development, the method may comprise the following additional steps: adjusting the condensation temperature to a first temperature value; and adjusting the condensation temperature to a second temperature value, when the condensed working medium having the first temperature value has reached the pump; wherein the second temperature value is higher than the first temperature value. The coldest point in the system is normally the condenser. If this should not be the case in the standstill condition, the condenser can be adjusted as coldest point in this way, e.g. by controlling the heat sink, (e.g. starting cooling at the condenser).

According to another further development, the adjustment of the condensation temperature to a second temperature value may be effected by lowering the rotational speed of a condenser fan and/or by reducing a cooling water mass flow or the air mass flow and/or by increasing the temperature of the cooling water mass flow or of the air mass flow through the condenser. Alternatively or additionally, also further measures, such as the closing of louvers or shutters of the condenser, can lead to an increase in the condensation temperature.

Another further development is to be seen in that the following additional steps may be provided: opening the expansion machine bypass valve prior to or simultaneously with the application of heat to the evaporator or opening the expansion machine bypass valve a predetermined first period of time after the application of heat to the evaporator or after a predetermined first pressure at the expansion machine has been reached; and closing the expansion machine bypass valve after or simultaneously with the starting of the pump or closing the expansion machine bypass valve a predetermined second period of time prior to starting the pump or after a predetermined second pressure at the expansion machine has been reached.

According to another further development, the following additional steps may be provided: opening the pump bypass valve and/or the recuperator bypass valve prior to, during or a predetermined third period of time subsequent to the application of heat to the evaporator; and closing the pump bypass valve and/or the recuperator bypass valve after, during or a predetermined fourth period of time prior to the start of the pump.

The above mentioned further developments may be used separately or in a suitable combination with one another.

Additional features and exemplary embodiments as well as advantages of the present invention will be explained in more detail hereinbelow making reference to the drawings. It should be understood that the embodiments do not exhaust the scope of the present invention. It should also be understood that some or all of the features described hereinbelow may also be combined with one another in some other way.

DRAWINGS

EMBODIMENTS

Figure 1:
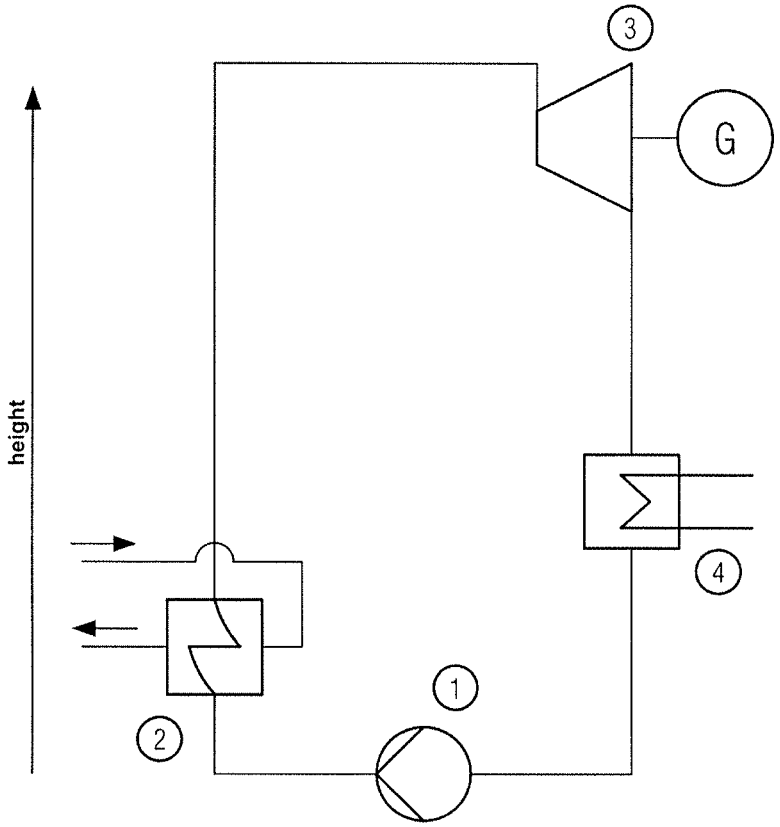
FIG. 1 shows the height arrangement in a thermodynamic cycle apparatus, in particular in an ORC system according to the present invention.

FIG. 1 shows a thermodynamic cycle apparatus, in particular an ORC system, and the height-ordered arrangement of the main components. The system comprises a feed pump 1 conveying the liquid working medium, with a substantial increase in pressure, to an evaporator 2 where the working medium is evaporated, an expansion machine 3 in which the highly pressurized vapor is expanded whereby mechanical energy is generated. This mechanical energy can be converted into electric energy e.g. through a generator G. From the condenser 4, in which the low pressure vapor coming from the expansion machine 3 is liquefied, the liquid working medium is returned to the feed pump 1 of the system via a possible (optional) storage tank (feed tank) and a suction line.

In the following, the startup process will be described and it will be explained how the problem is solved by the arrangement described.

Automatic positioning of the liquid working medium: the plant is to be started from a standstill condition. First, heat is applied to the evaporator (if the heat should not be applied to the evaporator in an uncontrolled manner, i.e. by a continuous flow of a heat transfer medium, it must be added). Vapor forms in the evaporator; this vapor heats the plant components, evaporates working medium that is present in a liquid state in other parts of the plant (e.g. in the expansion machine, horizontal tubes or fluid pouches) and flows together therewith to the condenser where it is liquefied after some time. Hence, fluid is shifted from the evaporator to the condenser. This leads to a rise of the fluid level on the condenser side, which, in turn, results in a pressure gradient from the cold condenser side to the hot evaporator side. Through the connection described (without closed shut-off devices) a flow is created, which causes the medium to flow from the condenser via the pump to the evaporator. The path must here be configured such that the flow will occur due to the force of gravity alone. In this respect, the pressure losses of the installed components or the opening pressures of installed valves must be taken into account.

Creating the head height and starting the system: the ordered distribution of liquid medium (as described above) and the collection of a sufficient amount of working medium upstream of the pump does, however, not yet guarantee that the medium will be applied to the pump with sufficient head height ($NPSH_a$) for allowing the pump to be started. For establishing a sufficient head height, the following course of action can be adopted: by cooling the condenser (by means of a heat sink, such as ambient air or cooling water), the condensation temperature and, consequently, the pressure in the condenser is first reduced. Condensate having a lower temperature flows from the condenser into the feed tank (if provided) and subsequently into the feed line leading to the pump. After some time, as the lower condensation temperature ensues, the fluid arrives at the pump through natural circulation. Now, the temperature in the condenser is increased, e.g. by controlling the heat sink, whereby also the pressure in the condenser will rise. This can be accomplished e.g. by lowering the rotational speed of a condenser fan and/or by reducing a cooling water mass flow or the air mass flow and/or by increasing the temperature of the cooling water mass flow or of the air mass flow through the condenser. Due to the colder fluid applied to the pump and the increased pressure in the condenser, the head height applied to the pump will increase. When a limit value of the head height ($NPSH_a > NPSH_r$) has been exceeded or after a certain, experience-based period of time, the pump can be started so as to begin the regular startup process of the ORC system.

Contrary to the above, the prior art teaches (as explained hereinbefore) that vapor lines should always be installed such that they slope towards the condenser/feed tank.

Figure 2:
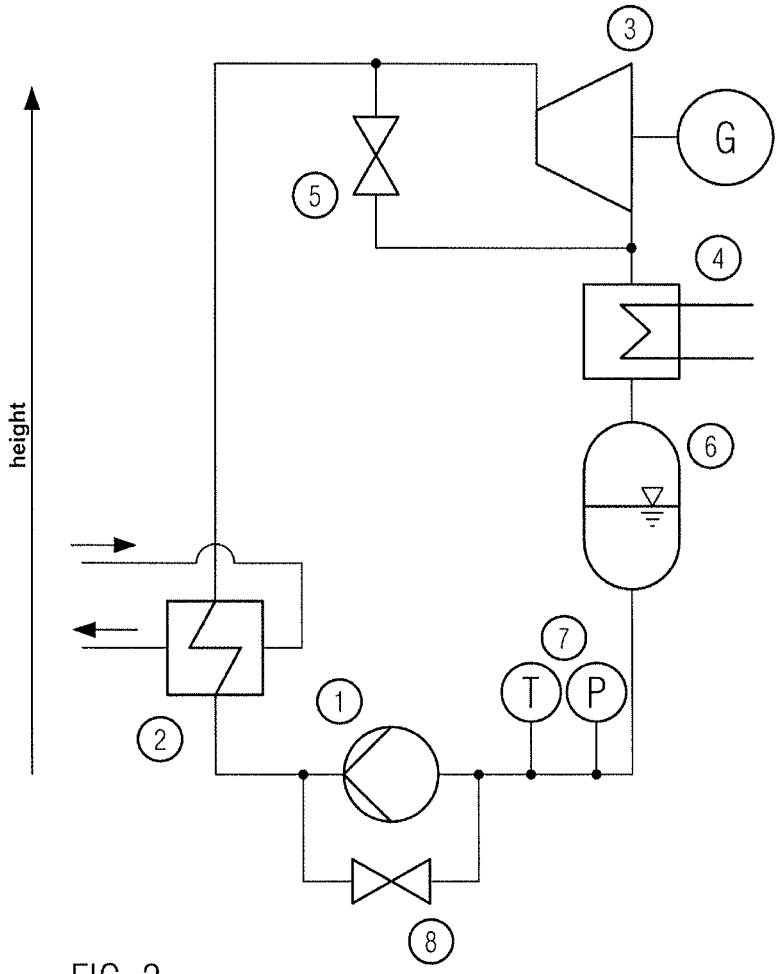
FIG. 2 shows an embodiment with combinable advantageous further developments of the thermodynamic cycle apparatus according to FIG. 1.

The device according to FIG. 2 comprises additional components so as to improve the arrangement shown in FIG. 1. These components and their functions will be described in the following.

Component 5 stands for a bypass valve on the expansion machine 3. This bypass valve 5 via the expansion machine allows, e.g. in the case of volumetric expansion machines, a sufficient amount of the vapor produced in the evaporator to flow to the condenser 4. The bypass valve may additionally be used as an emergency shutdown valve allowing, in case of danger, a rapid expansion of the high pressure vapor upstream of the expansion machine. The bypass valve may e.g. be configured as a magnetic valve that is open when currentless. In the case of a start with the described arrangement of the components, the valve remains open thus allowing the natural circulation of the working medium. The valve is required for the described function, if the amount of working medium via an inoperative (or also a rotating) expansion machine does not suffice for the aimed-at natural circulation of the fluid.

Component 6 stands for a feed tank. The feed tank may be required for providing, in any operating condition, a sufficient amount of working medium that is applied to the feed pump. It buffers the whole amount of working medium and prevents thus downtimes of the plant caused by working medium losses, an uneven distribution of the working medium, different vapor densities and, consequently, vapor masses during operation and standstill or inaccurate filling of the system. In connection with the use with inert gas, the tank has to fulfil an additional function. It increases the gas volume in the system. The head height can thus be kept comparatively constant throughout all operating conditions (cf. in this respect also the disclosure in DE 10 2009 053 390 B3). When inert gas is used for preventing cavitation, a further advantage is achieved by the described arrangement in natural circulation. A constant circulation of working medium, which is caused exclusively by the difference in temperature and the resultant difference in pressure between the evaporator and the condenser and which is independent of the operation of the feed pump, ensures that the inert gas present in the circuit will automatically collect in the condenser and in the feed tank. As described in DE 10 2009 053 390 B3, the inert gas, which is present in the feed tank, increases the head height to the pump due to its concentration-dependent partial pressure. Since, in the standstill condition, the inert gas distributes in the entire plant due to diffusion and since the partial pressure in the feed tank therefore decreases, cavitation-free starting of the pump from a standstill condition cannot always be guaranteed without a concentration of the inert gas in the feed tank through e.g. the above described natural circulation. This must be compensated for by a larger amount of inert gas and/or by a larger feed tank with a larger vapor volume, so that the system can reliably be started even from a standstill condition. The necessary amount of inert gas can be reduced by the method described, and this will lead to an increase in the pressure difference at the expansion machine and to an increase in the performance produced (enhancement of system efficiency).

Component 7 stands for sensors for measuring the applied head height ($NPSH_a$). The possibility of providing sensors (here e.g. pressure P and temperature T) allows a determination of the head height ($NPSH_a$). This can be used as a start criterion for starting the pump during the above described startup process of the system.

Component 8 stands for a bypass valve for bypassing the feed pump. This valve 8 for bypassing the feed pump may be used in the above described case for guaranteeing a sufficient flow of liquid working medium from the condenser to the evaporator. This becomes necessary e.g. in cases where, due to its structural design/construction (e.g. displacement pump), the feed pump does not allow any medium to pass in its standstill condition. Another reason may be the large height difference which has to be overcome in the pump (e.g. in vertical multi-stage rotary pumps) and which prevents a natural flow. The bypass valve may be configured such that it is switchable or controllable. In addition, it may be configured as a spring-loaded valve having adjustable or fixed opening and closing pressures. The valve will therefore not open until a specific applied pressure difference between the suction side and the pressure side of the pump has been reached and remain closed when the plant is in operation, or the valve will be open up to a specific pressure difference between the pressure side and the suction side and will close automatically when operation takes place from this specific pressure difference between the pressure side and the suction side onwards. The pressure difference for opening the valve must be so small that natural circulation is possible. In addition, the valve may serve as a safety valve in case of danger. Due to rapid opening of the valve in case of danger, the medium can flow from the evaporator towards the condenser. This prevents an excessive increase in pressure in the evaporator through further evaporation of working medium. In order to prevent working medium from flowing back from the evaporator to the pump at certain operating points, e.g. for protecting the pump against hot working medium, a check valve (not shown in the drawing) may additionally be provided downstream of the pump.

Figure 3:
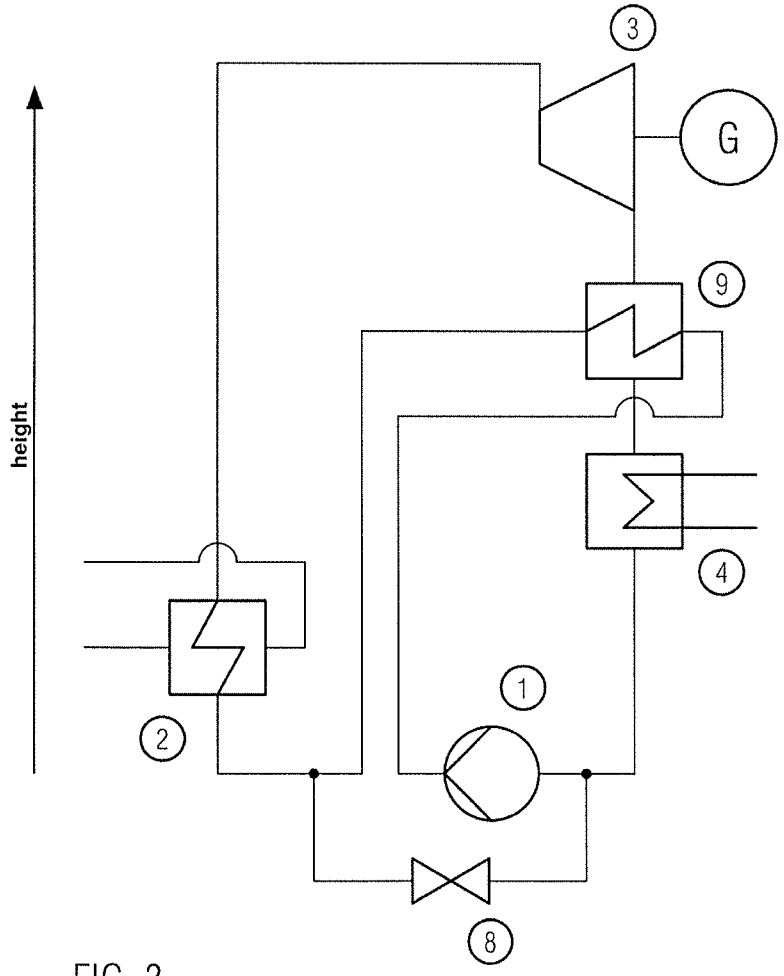
FIG. 3 shows a further embodiment of the thermodynamic cycle apparatus according to the present invention.

FIG. 3 shows an embodiment of the thermodynamic cycle apparatus with a recuperator 9. The recuperator 9 serves to transfer thermal energy from the expanded working medium to the working medium pumped between the pump 1 and the evaporator 2 during operation of the thermodynamic cycle apparatus, the recuperator 9 being arranged between the expansion machine 3 and the condenser 4. In addition, a bypass valve 8 is provided for bridging the recuperator 9 in the circuit, the bypass valve 8 for bridging the recuperator 9 being here also the bypass valve 8 for bypassing the pump 1. When the tubing between the pump 1 and the evaporator 2 is installed such that it passes through the recuperator 9 so as to preheat, during normal operation of the thermodynamic cycle apparatus, the working medium pumped therein with heat from the expanded evaporated working medium between the expansion machine 3 and the condenser 4, the bypass valve 8 used for bridging the recuperator 9 must be open for starting the cycle apparatus in the way described according to the present invention, since the recuperator 9, which is arranged on a higher level than the evaporator 2, will otherwise not allow natural circulation of the working medium.

Summarizing, the following can be stated: the method according to the present invention as well as the device according to the present invention (height arrangement) guarantee that the ORC can be started reliably and rapidly. The method in its simple version does not require any sensors or actuators (e.g. valves) for a reliable start. Due to the automatic distribution of the working medium in the system, the total amount of working medium in the system can be reduced in comparison with systems having a different mode of arrangement (e.g. with an evaporator on a higher level and a low-lying condenser or expansion machine), since, due to the unpowered positioning of the liquid working medium, a sufficient amount of fluid is always present in the suction line of the pump. The automatic heating of the system through natural circulation due to heat supply ensures preheating of the components. Under cold atmospheric conditions, this can accelerate the start of the system and have an effect that will lengthen the service life of the components. The reliable, cavitation-free starting of the plant prevents possible damage that may be caused to the pump and that may occur at the pump due to (partial) cavitation. The method is able to guarantee a sufficient head height for the feed pump in the startup process. Hence, other methods which would otherwise be necessary for establishing a head height can be dispensed with or their influence on the efficiency of the plant can be reduced. Since other methods (e.g. subcooling of the condensate or an addition of inert gas) have a performance-impairing effect, the method described leads to an increase in the total efficiency of the ORC system. The method described allows the filling quantity of working medium to be saved. Experience has shown that the starting ability of ORC systems can otherwise only be guaranteed by large quantities of working medium. The working medium, which is available at prices of 20-80 € /$k_g$, has a substantial influence on the cost effectiveness of ORC systems. In addition, when the amounts contained in the system are smaller, this will allow an extension of prescribed maintenance intervals and a reduction of maintenance requirements (F-gas Regulation), and this can lead to a substantial lowering of costs in operation. Attention should, however, be paid to the fact that the heat input into the system cannot be stopped in a self-inhibiting manner—such as by means of an overhead evaporator. This may be disadvantageous e.g. with respect to maintenance work, but the heat input should then be prevented, if necessary, through other, additional measures.

The embodiments shown are only exemplary embodiments and the complete scope of the present invention is defined by the claims.

The invention claimed is:

1. A thermodynamic cycle apparatus, in particular an organic Rankine cycle apparatus, comprising:

a working medium;

an evaporator for evaporating and additionally superheating the working medium;

an expansion machine for generating mechanical energy while expanding the evaporated working medium;

a condenser for condensing and additionally subcooling the working medium, in particular the working medium expanded in the expansion machine;

a pump for pumping the condensed working medium to the condenser when the thermodynamic cycle apparatus is in operation;

a first means for controlling a head height of the condensed working medium that is applied to the pump, the first means comprises a second means for at least temporarily increasing a pressure in the condenser, wherein the second means comprises at least one selected from the group of: (i) a means for lowering a rotational speed of a condenser fan, (ii) a means for reducing a cooling water mass flow or an air mass flow through the condenser, and (iii) a means for increasing a temperature of a cooling water mass flow or an air mass flow through the condenser;

wherein the geometrical arrangement of the evaporator is selected such that, prior to starting the pump, the condensed working medium can flow from the condenser to the evaporator by force of gravity and the working medium can circulate in a closed circuit via the evaporator and the condenser, to provide at least a predetermined minimum head height of the liquid working medium at the pump; and wherein the evaporator is located on a lower level than the condenser in the geometrical arrangement and the pump is located on a lower level than the evaporator in the geometrical arrangement.

2. The thermodynamic cycle apparatus according to claim 1, wherein the closed circuit between the condenser and the evaporator also comprises the non-started pump and/or wherein the closed circuit between the evaporator and the condenser also comprises the expansion machine.

3. The thermodynamic cycle apparatus according to claim 1, further comprising a bypass valve for bypassing the expansion machine in the circuit.

4. The thermodynamic cycle apparatus according to claim 1, further comprising a feed tank for collecting the condensed working medium, the feed tank being arranged in the closed circuit between the condenser and the evaporator, in particular between the condenser and the pump.

5. The thermodynamic cycle apparatus according to claim 1, further comprising: at least one sensor for measuring the head height of the working medium upstream of the pump, in particular a sensor for measuring the pressure of the working medium and/or a sensor for measuring the temperature of the working medium.

6. The thermodynamic cycle apparatus according to claim 1, further comprising a bypass valve for bypassing the pump in the circuit.

7. The thermodynamic cycle apparatus according to claim 1, further comprising:

a recuperator for transferring thermal energy from the expanded working medium to the working medium pumped between the pump and the evaporator when the thermodynamic cycle apparatus is in operation, the recuperator being arranged between the expansion machine and the condenser; and a bypass valve for bridging the recuperator in the circuit.

8. A thermodynamic cycle apparatus, in particular an organic Rankine cycle apparatus, comprising:

a working medium;

an evaporator for evaporating and additionally superheating the working medium;

an expansion machine for generating mechanical energy while expanding the evaporated working medium;

a condenser for condensing and additionally subcooling the working medium expanded in the expansion machine; and a pump for pumping the condensed working medium to the condenser when the thermodynamic cycle apparatus is in operation;

a recuperator for transferring thermal energy from the expanded working medium to the working medium pumped between the pump and the evaporator when the thermodynamic cycle apparatus is in operation, the recuperator being arranged between the expansion machine and the condenser; and a bypass valve for bridging the recuperator in the circuit and for bypassing the pump, wherein the evaporator is located on a lower level than the condenser such that, prior to starting the pump, the condensed working medium can flow from the condenser to the evaporator by force of gravity and the working medium can circulate in a closed circuit via the evaporator and the condenser, to provide at least a predetermined minimum head height of the liquid working medium at the pump.

9. The thermodynamic cycle apparatus according to claim 8, wherein the pump is located on a lower level than the evaporator.

10. The thermodynamic cycle apparatus according to claim 8, wherein the closed circuit between the condenser and the evaporator also comprises the pump and the expansion machine.

11. The thermodynamic cycle apparatus according to claim 8, further comprising a bypass valve for bypassing the expansion machine in the circuit.

12. A method of starting a thermodynamic cycle apparatus, the thermodynamic cycle apparatus comprising:

a working medium;

an evaporator for evaporating and additionally superheating the working medium;

an expansion machine for generating mechanical energy while expanding the evaporated working medium;

a condenser for condensing and additionally subcooling the working medium, in particular the working medium expanded in the expansion machine, wherein the evaporator is located on a lower level than the condenser; and a pump for pumping the condensed working medium to the condenser when the thermodynamic cycle apparatus is in operation;

the method comprising the following steps:

applying heat to the evaporator and evaporating the working medium in the evaporator, superheating the working medium in the evaporator, wherein the working medium is caused to flow to the condenser;

adjusting a condensation temperature to a first temperature value;

adjusting the condensation temperature to a second temperature value, when the condensed working medium having the first temperature value has reached the pump, wherein the second temperature value is higher than the first temperature value;

condensing the working medium in the condenser; and starting the pump when a predetermined head height of the working medium at the pump is reached or exceeded.

13. The method according to claim 12, wherein the pump is started when a measured head height has been reached or exceeded, or when a predetermined period of time has elapsed after the beginning of the application of heat to the evaporator.

14. The method according to claim 12, wherein the adjustment of the condensation temperature to a second temperature value is effected by lowering a rotational speed of a condenser fan and/or by reducing a cooling water mass flow or an air mass flow through the condenser and/or by increasing the temperature of the cooling water mass flow or of the air mass flow through the condenser.

15. The method according to claim 12, comprising the following additional steps:

opening an expansion machine bypass valve prior to or simultaneously with the application of heat to the evaporator or opening an expansion machine bypass valve a predetermined first period of time after the application of heat to the evaporator or after a predetermined first pressure at the expansion machine has been reached; and closing the expansion machine bypass valve after or simultaneously with the starting of the pump or closing the expansion machine bypass valve a predetermined second period of time prior to starting the pump or after a predetermined second pressure at the expansion machine has been reached.

16. The method according to claim 12, comprising the following additional steps:

opening a pump bypass valve and/or a recuperator bypass valve prior to, during or a predetermined third period of time subsequent to the application of heat to the evaporator; and closing the pump bypass valve and/or the recuperator bypass valve after, or during a predetermined fourth period of time prior to the start of the pump.

* * * * *